US005702313A

United States Patent [19]

Stennett

[11] Patent Number: 5,702,313

[45] Date of Patent: Dec. 30, 1997

[54] GAME RACKET WITH PRIMARY AND SECONDARY YOKES

[75] Inventor: Patrick G. Stennett, Springfield, Mass.

[73] Assignee: Lisco, Inc., Tampa, Fla.

[21] Appl. No.: 799,286

[22] Filed: Feb. 13, 1997

[51] Int. Cl.[6] ..... A63B 49/02

[52] U.S. Cl. ..... 473/546; 473/539

[58] Field of Search ..... 473/546, 539, 473/543, 524

[56] References Cited

U.S. PATENT DOCUMENTS

| | | | |
|---|---|---|---|
| 4,138,109 | 2/1979 | Nobbs | 473/539 |
| 4,141,551 | 2/1979 | Goransson | 473/543 |
| 4,322,076 | 3/1982 | Bertram et al. | 473/546 X |
| 4,333,650 | 6/1982 | Soong | 473/546 X |
| 4,437,662 | 3/1984 | Soong | 473/546 X |
| 4,828,259 | 5/1989 | Davis | 473/522 |
| 5,137,273 | 8/1992 | Jseng | 473/543 |
| 5,306,004 | 4/1994 | Soong | 473/546 X |

FOREIGN PATENT DOCUMENTS

| | | | |
|---|---|---|---|
| 344611 | 12/1989 | European Pat. Off. | 473/181 |
| 2226250 | 6/1990 | United Kingdom | 473/181 |

*Primary Examiner*—Raleigh W. Chiu

[57] ABSTRACT

The present invention relates to a game racquet with employs a hitting area composed of a longitudinal and a lateral string. Specifically, the present invention is directed to such a racquet with a frame that allows for centrally disposed longitudinal string segments of an extended length. These centrally disposed longitudinal segments extend through enlarged apertures within a primary yoke, or throat bridge, and are anchored through a secondary yoke, or throat bridge. Thus, the game racquet of the present invention includes a plurality of longitudinal segments with the center most segments having a length greater than that of the adjacent lengths. Such a construction gives the string bed increased resiliency without increasing the string bed area.

6 Claims, 2 Drawing Sheets

GAME RACKET WITH PRIMARY AND SECONDARY YOKES

BACKGROUND OF THE INVENTION

1. Field of the Invention

The present invention relates to a game racquet with primary and secondary yokes and, more particularly, pertains to such a racquet with increased string bed resiliency.

2. Description of the Prior Art

The use of game racquets is known in the prior art. These racquets are used to strike a resilient ball. In the game of tennis such racquets are employed to hit a ball over a net. Such game rackets are constructed of a frame having a handle portion gripped by the player, a looped head portion with crossed strings for striking the ball, and having an intermediate portion coupling the handle portion and the head portion. The strings can be strung in tension to enable a player to deliver more power to the game ball.

For example, U.S. Pat. No. 4,322,076 to Bertram et al. discloses a ball playing racket with crosswise string sections and longitudinal string sections. U.S. Pat. No. 4,333,650 to Soong discloses a string load apportioned racket with longer longitudinal strings which are strung with at least 30% more tension than all other strings. U.S. Pat. No. 4,437,662 to Soong discloses a string load apportioned racket with longer longitudinal strings which are strung with at least 30% more tension than the transverse strings. U.S. Pat. No. 4,828,259 to Davis discloses a tennis racquet with a double throat bridge. U.S. Pat. No. 4,976,433 to Pohlenz et al. discloses a gas spring incorporated into a tennis racket. U.S. Pat. No. 5,020,800 discloses a shock damping and absorbing racket. U.S. Pat. No. 5,141,228 to Soong discloses a shock absorbing string post for a sports racket. U.S. Pat. No. 5,263,712 to Lo discloses a game racket having a fiber reinforced shaft. U.S. Pat. No. 4,138,109 to Nobbs discloses a racket and throat piece therefor. U.S. Pat. No. 4,141,551 to Goransson discloses a racket head built up by crossing strings fastened to a frame. Lastly, U.S. Pat. No. 4,151,995 to Weed discloses a tennis racket with a playable throat area.

As illustrated by the great number of patents as well as commercial rackets, efforts are continuously being made in an attempt to improve rackets. Such efforts are made to render rackets of ever increasing capabilities during play. None of these previous efforts, however, provides the benefits attendant with the present invention. Additionally, the prior patents and commercial devices do not suggest the present inventive combination of methods steps and component elements arranged and configured as disclosed and claimed herein. The present invention achieves its intended purposes, objects and advantages through a new, useful and unobvious combination of method steps and component elements, with the use of a minimum number of functioning parts, at a reasonable cost to manufacture and by employing only readily available materials.

Therefore, it is an object of the present invention to provide new and improved game racquet. Specifically, the present invention is directed to such a racquet with a frame that allows for centrally disposed longitudinal string segments of an extended length. The centrally disposed longitudinal string segments extend through enlarged apertures within a primary yoke, or throat bridge, and are anchored through a secondary yoke, or throat bridge. Thus, the game racquet of the present invention includes a lengthwise, or longitudinal string which is strung in a series of longitudinal segments, with the center most segments having a length greater than that of the adjacent longitudinal segments. Furthermore, the apertures formed within the primary throat bridge are of a sufficient diameter that the segments are suspended through the length of the aperture. In this manner, the centrally disposed longitudinal segments are allowed a greater degree of lateral freedom than the adjacent longitudinal segments.

It is another object of the present invention to provide a new and improved game racquet with a frame construction that allows for the use of centrally disposed longitudinal string segments of increased length.

It is further object of the present invention to provide a new and improved game racquet with primary and secondary yokes which is of durable and reliable construction.

An even further object of the present invention is to provide a new and improved game racquet with primary and secondary yokes which is susceptible of a low cost of manufacture with regard to both materials and labor, and which accordingly is then susceptible of low prices of sale to the consuming public, thereby making such game racquet economically available to the buying public.

Still yet another object of the present invention is to provide new and improved game racquet with primary and secondary yokes which provides in the apparatuses and methods of the prior art some of the advantages thereof, while simultaneously overcoming some of the disadvantages normally associated therewith.

Even still another object of the present invention is to give better vibration dampening characteristics in a racquet without increasing the overall string bed area.

In this respect, the game racquet according to the present invention substantially departs from the conventional concepts and designs of the prior art, and in doing so provides an apparatus primarily developed for the purpose of increasing string bed resilience without increasing the overall string bed area.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the attached claims with the specific embodiments shown in the attached drawings. For the purposes of summarizing the present invention, the present invention essentially comprises a game racquet including a handle end with a grip portion formed thereon. The handle end has both a lower butt end and an upper extent. The throat region has a lower extent coextensive with the upper extent of the handle end, and an upper extent which is wider than the lower extent. The racquet also includes a generally oval hitting region with the hitting region having a length, and a lower extent coextensive with the upper extent of the throat region. An arcuate primary throat bridge serves to form the lower extent of the oval hitting region. This primary throat bridge has four oversized apertures formed therethrough. An oversize grommet is positioned within each of the oversized apertures, and each of the grommets is defined by an internal surface and a diameter. In a similar fashion, an arcuate secondary throat bridge is formed intermediate the primary throat bridge and the lower extent of the throat region. A longitudinal string is strung in segments which extend the length of the hitting region, with the longitudinal string having a diameter. Four of these longitudinal segments, the center most segments, extend through the grommets of the primary throat bridge. The grommets of the primary throat bridge have a diameter that is several times larger than the diameter of the longitudinal string such that each of the center most longitudinal segments is suspended from the internal surface of the corresponding grommet when the string is in an undisturbed state. Each of the four segments, after passing through the primary yoke, is secured through the secondary yoke.

The foregoing has outlined rather broadly the more pertinent and important features of the present invention. The detailed description of the invention that follows is offered so that the present contribution to the art may be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other methods and structures for carrying out the same purposes of the present invention. It should also be realized by those skilled in the art that such equivalent methods and structures do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which.

The same reference numerals refer to the same parts through the various Figures.

DESCRIPTION OF THE PREFERRED EMBODIMENT

Figure 1:
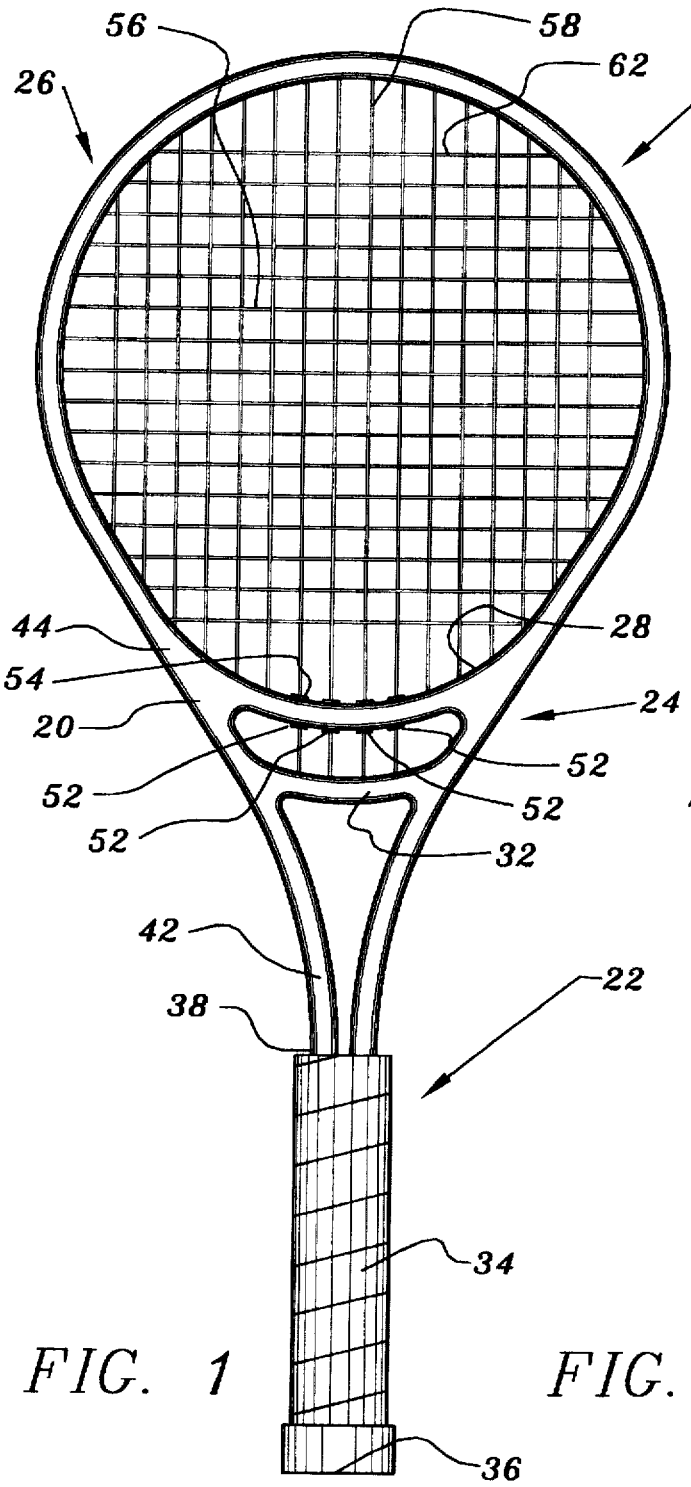
FIG. 1 is a front elevational view of the game racquet construction in accordance with the present invention.
Figure 2:
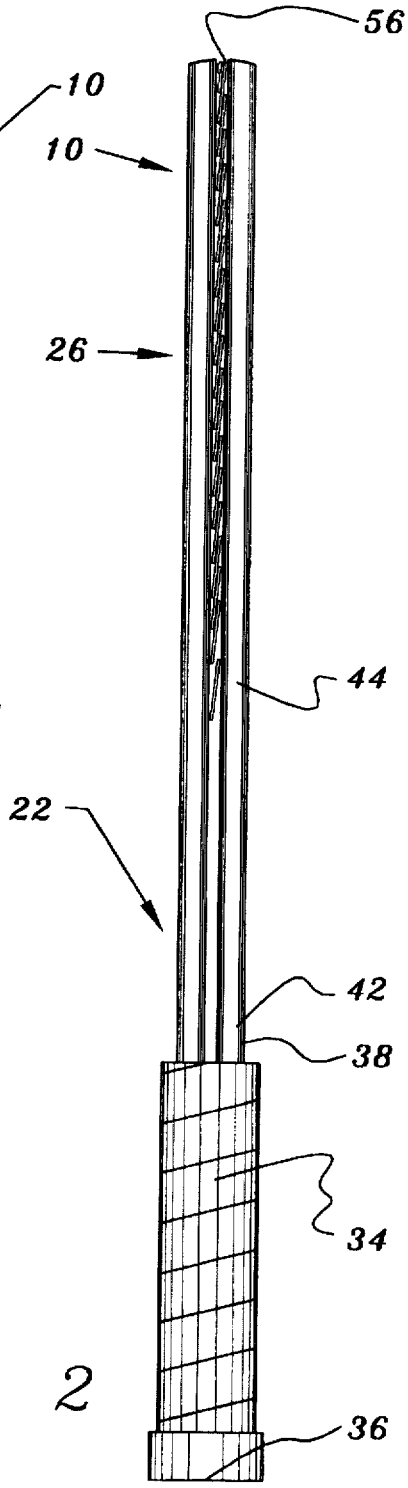
FIG. 2 is a side elevational view of the game racquet constructed in accordance with the present invention.

With reference now to the drawings, and in particular to FIG. 1 thereof, the preferred embodiment of the new and improved game racquet embodying the principles and concepts of the present invention and generally designated by the reference numeral 10 will be described.

The present invention relates to a game racquet, particularly a tennis racquet, with a hitting area with both a longitudinal and lateral string. Both of these strings are strung in lengths or segments. Specifically, the present invention is directed to such a racquet with a frame that allows for centrally disposed longitudinal string segments of an extended length. The centrally disposed longitudinal string segments extend through enlarged apertures within a primary yoke, or throat bridge, and are anchored through a secondary yoke, or throat bridge. Thus, the game racquet of the present invention includes a plurality of lengthwise, or longitudinal string segments, with the center most string segments having a length greater than that of the adjacent string segments. Furthermore, the apertures formed within the primary throat bridge are of a sufficient diameter that the string segments are suspended through the length of the aperture. In this manner, the centrally disposed string segments are allowed a greater degree of lateral freedom than the adjacent string segments. The various components of the present invention, and the manner in which they interrelate, will be described in greater detail hereinafter.

The racquet frame 20 employed in conjunction with the present invention includes a handle portion 22, a throat region 24, and a hitting region 26. Furthermore, the throat region 24 includes both a primary and a secondary throat bridge, 28 and 32 respectively. The handle portion 22 is defined by a handle end with a grip portion 34 formed thereon. The handle end, in turn, is defined by a lower butt end 36 and an upper extent 38. In a similar fashion, the throat region 24 is defined by both a lower extent 42 and an upper extent 44, with the lower extent 42 coextensive with the upper extent 44 of the handle end. With reference to FIG. 1, the upper extent 44 of the throat region 24 has a width which is substantially wider than its lower extent 42. With continuing reference to FIG. 1, the generally oval hitting region 26 is defined by a length, and both a lower and an upper extent, 46 and 48 respectively. The lower extent 46 of the hitting region 26 is coextensive with the upper extent 44 of the throat region 24.

Next, the primary 28 and secondary 32 throat bridges will be described. The primary throat bridge 28 is arcuate in shape and forms the lower extent 46 of the oval hitting region 26. This primary throat bridge 28, in the preferred embodiment, includes four oversized apertures 52 formed through its width. Although the present invention has been described in conjunction with four such apertures 52 any other number of such apertures can be employed. Furthermore, in the preferred embodiment, an oversize grommet is positioned within each of these oversized apertures. Each of the grommets 54 is defined by an internal surface, a diameter and a length.

The secondary throat bridge 32 is also arcuate in shape and is formed intermediate the primary throat bridge 28 and the lower extent 42 of the throat region 24. The relationship between the primary 28 and secondary 32 throat bridges is best illustrated in FIG. 1. Specifically, the primary throat bridge 28 is positioned at a location closer to the hitting region 26 than the secondary throat bridge 32. With continuing reference to FIG. 1, the arcuate nature of both bridges is illustrated. Furthermore, each of these arcuate bridges have approximately the same radius of curvature, in other words, the primary 28 and secondary bridges 32 are substantially parallel to one another.

The hitting region 26 of the racquet 10 of the present invention employs of strings 56. Namely, the hitting region 26 is comprised of a longitudinal string 58 and a lateral string 62. The longitudinal string is strung in longitudinal lengths, or segments, and the lateral string is strung in lateral lengths, or segments. Specifically, the longitudinal segments are created by threading the longitudinal string through apertures in the periphery of the racquet. In a similar fashion, the lateral string is threaded through apertures in the periphery of the racquet to create the lateral segments. Both the longitudinal 58 and the lateral string 62 are in equal tension. In the preferred embodiment, the longitudinal string 58 is strung in segments which are each parallel to one another and extend the length of the hitting region 26. Furthermore, the longitudinal string 58 is defined by a diameter and a length. Similarly, the lateral string 62, which is defined by a diameter, is strung such that the lateral segments are parallel. In the preferred embodiment, four of the longitudinal segments, the center most longitudinal segments, extend through the grommets 54 of the primary throat bridge 28. However, in an alternative embodiment, if no such grommets 54 are included within the primary bridge 28, the segments can simply extend through the apertures 52 of the bridge 28. Furthermore, although the present invention has been described in conjunction with four such apertures 52 and central segments any other number of apertures and corresponding center segments will suffice, with the number of apertures corresponding in number to the number of centrally positioned longitudinal segments.

Figure 3:
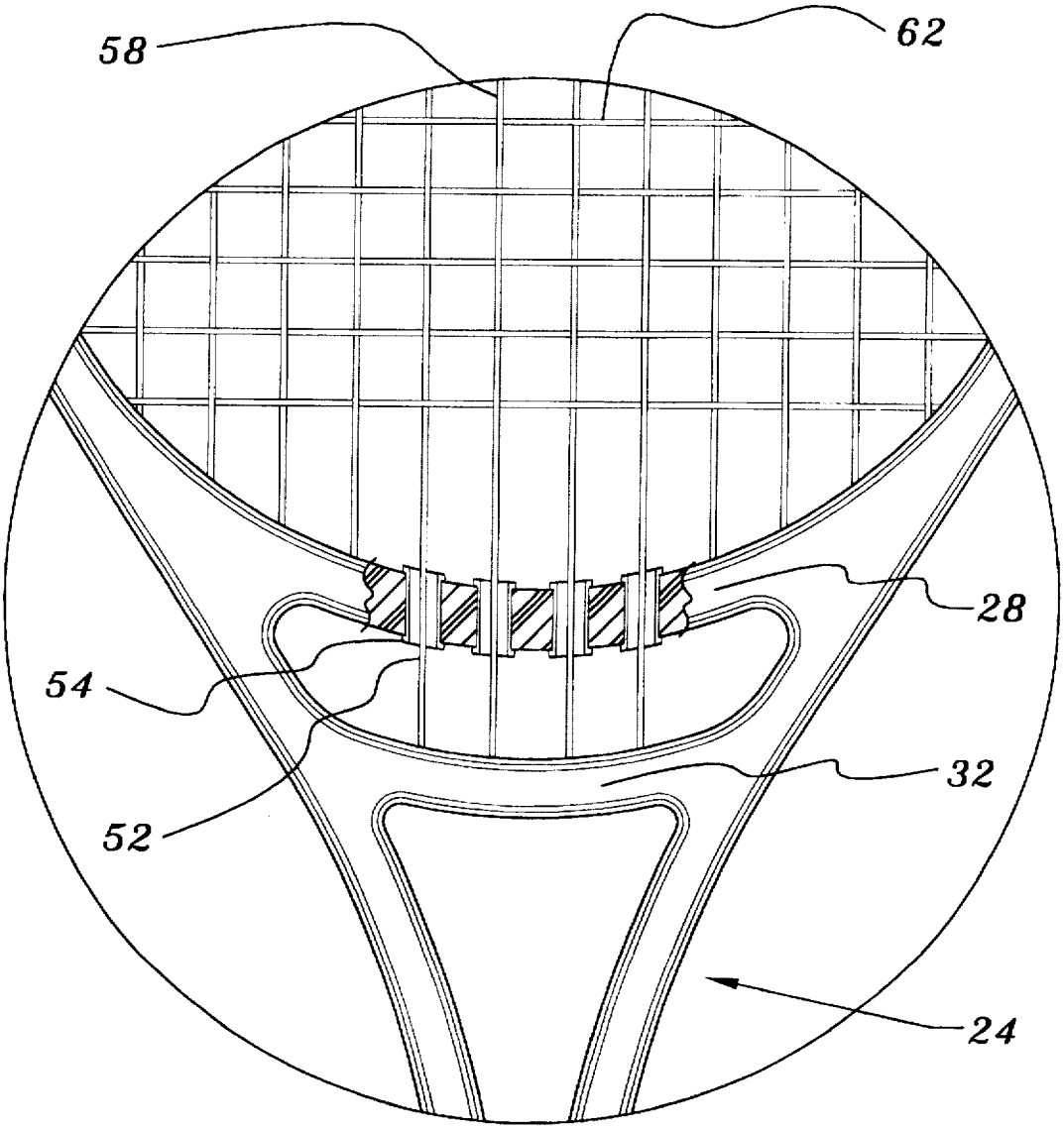
FIG. 3 is an enlarged view of the primary and secondary yokes employed in conjunction with present invention.

With reference to FIG. 3, each of the grommets 54 of the primary throat bridge 28 have a diameter which is several times larger than the diameter of the longitudinal string 58. In this manner each of the centrally positioned longitudinal segments is suspended from the internal surface of the corresponding grommet when the string is in an undisturbed state. In a similar fashion, if no grommets are utilized, the apertures 52 within the primary bridge 28 are of a sufficient diameter that each of the longitudinal segments is suspended from the internal surface of the aperture. After passing though the primary bridge 28 the central longitudinal segments are secured through the secondary bridge 32.

Thus, what has been described is a game racquet 10 with both primary 28 and secondary yokes 32. Such yokes enable the center most longitudinal segments of the hitting area 26 to be of an increased length. Such increase in length is provided by the segments passing unencumbered through apertures 52 in the primary bridge 28, or yoke. Such a construction increases the overall resiliency, and consequently the overall power potential, without increasing the size of the hitting area 26. In other words, the hitting area 26, or string bed, maintains its size, but through the use of two yokes the resiliency is increased. Such a construction also enhances the vibration damping characteristics of the racket 10.

The present disclosure includes that contained in the appended claims as well as that of the foregoing description. Although this invention has been described in its preferred form with a certain degree of particularity, it should be understood that the present disclosure of the preferred form has been made only by way of example and that numerous changes in the details of construction and combination and arrangement of parts may be resorted to without departing from the spirit and scope of the invention.

What is claimed is:

1. A game racquet comprising, in combination:

a handle end with a grip portion formed thereon, the handle end having a lower butt end and an upper extent;

a throat region having a lower extent coextensive with the upper extent of the handle end, and a upper extent which is wider than the lower extent;

a generally oval hitting region, the hitting region having a length, and a lower extent coextensive with the upper extent of the throat region;

an arcuate primary throat bridge forming the lower extent of the oval hitting region, the primary throat bridge having four oversized apertures formed therethrough, an oversize grommet positioned within each of the oversized apertures, each of the grommets being defined by an internal surface and a diameter;

an arcuate secondary throat bridge formed intermediate the primary throat bridge and the lower extent of the throat region;

a longitudinal string strung in longitudinal segments which extend the length of the hitting region, the longitudinal string having a diameter, four of the longitudinal segments extending through the grommets of the primary throat bridge, the grommets of the primary throat bridge having a diameter several times larger than the diameter of the longitudinal string such that each of the longitudinal segments are suspended from the internal surface of the corresponding grommet when the string is in an undisturbed state;

each of the four longitudinal segments being secured through the secondary throat bridge;

a lateral string strung in lateral segments, wherein the lateral and the longitudinal lengths are in equal tension.

2. A game racquet comprising, in combination:

a handle end with a grip portion formed thereon, the handle end having a lower butt end and an upper extent;

a throat region having a lower extent coextensive with the upper extent of the handle end, and a upper extent which is wider than the lower extent;

a hitting region, the hitting region having a length, and a lower extent coextensive with the upper extent of the throat region;

a primary throat bridge forming the lower extent of the hitting region, the primary throat bridge having a number of apertures formed therethrough, each of the apertures being defined by an internal surface and a diameter;

a secondary throat bridge formed intermediate the primary throat bridge and the lower extent of the throat region;

a longitudinal string strung in longitudinal segments which extend the length of the hitting region, the longitudinal string having a diameter, a number of centrally positioned longitudinal segments, the number corresponding with the number of apertures formed within the primary throat bridge, each of the centrally positioned longitudinal segments extending through the apertures of the primary throat bridge, each of the centrally positioned longitudinal segments being secured through the secondary throat bridge.

3. The racquet frame as described in claim 2 wherein:

the apertures of the primary throat bridge having a diameter several times larger than the diameter of the longitudinal string such that each of the longitudinal segments is suspended from the internal surface of the corresponding aperture when the string is in an undisturbed state.

4. The racquet frame as described in claim 2 wherein:

each of the longitudinal segments is parallel to one another, and;

the primary and secondary throat bridges are arcuate.

5. The racquet frame as described in claim 2 further comprising:

an oversize grommet positioned within each of the oversized apertures, each of the grommets being defined by an internal surface and a diameter.

6. The racquet frame as described in claim 5 wherein:

each of the centrally positioned longitudinal segments extending through a corresponding grommet; and wherein the grommets of the primary throat bridge have a diameter several times larger than the diameter of the longitudinal string such that each of the centrally positioned longitudinal lengths is suspended from the internal surface of the corresponding grommet when the string is in an undisturbed state.

* * * * *